US007473289B2

(12) United States Patent
Oh et al.

(10) Patent No.: US 7,473,289 B2
(45) Date of Patent: Jan. 6, 2009

(54) MULTI-CYCLONE APPARATUS AND VACUUM CLEANER HAVING THE SAME

(75) Inventors: Jang-keun Oh, Gwangju (KR); Jung-gyun Han, Gwangju (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 441 days.

(21) Appl. No.: 11/286,000

(22) Filed: Nov. 23, 2005

(65) Prior Publication Data

US 2006/0230721 A1 Oct. 19, 2006

Related U.S. Application Data

(60) Provisional application No. 60/665,942, filed on Mar. 29, 2005.

(30) Foreign Application Priority Data

May 11, 2005 (KR) ..... 10-2005-0039125

(51) Int. Cl.
*B01D 45/12* (2006.01)
*B01D 50/00* (2006.01)

(52) U.S. Cl. ..... 55/318; 55/343; 55/349; 55/429; 55/459.1; 55/DIG. 3; 15/350; 15/353

(58) Field of Classification Search ..... 55/318, 55/343, 349, 429, 459.1, DIG. 3, 462; 15/350, 15/353
See application file for complete search history.

(56) References Cited

U.S. PATENT DOCUMENTS

| | | | | |
|---|---|---|---|---|
| 3,543,325 A | 12/1970 | Hamrick | ..... | 15/314 |
| 5,135,552 A * | 8/1992 | Weistra | ..... | 55/337 |
| 7,097,680 B2 * | 8/2006 | Oh | ..... | 55/343 |
| 2005/6050863 | 3/2005 | Oh | ..... | 55/345 |

FOREIGN PATENT DOCUMENTS

| | | |
|---|---|---|
| CA | 2445569 | 10/2003 |
| CA | 2445569 A1 | 4/2004 |
| CN | 1419885 A | 5/2003 |
| CN | 1593777 A | 3/2005 |
| EP | 0489468 | 6/1992 |
| EP | 1707094 | 10/2006 |
| WO | 01/35809 | 5/2001 |

OTHER PUBLICATIONS

European Office Action dated Jan. 23, 2007 based on European Application No. 06290002.2-1256.

* cited by examiner

*Primary Examiner*—Robert A Hopkins
(74) *Attorney, Agent, or Firm*—Ohlandt, Greeley, Ruggiero & Perle, LLP.

(57) ABSTRACT

A multi-cyclone apparatus is capable of separating and collecting contaminants by three stages. The multi-cyclone apparatus has a first collecting unit which separates large-sized contaminants from an air which is drawn through an air suction port, a cyclone body comprising a second cyclone which is communicated with the first collecting unit and separates middle-sized contaminants from the drawn air, and a plurality of third cyclones arranged around the second cyclone and separate small-sized contaminants from the drawn air, an air discharge port communicated with the cyclone body, through which the air is discharged after passing through the third cyclones, and a contaminant receptacle provided to a lower end of the cyclone body, and collects contaminants separated from the second and the third cyclones.

10 Claims, 4 Drawing Sheets

MULTI-CYCLONE APPARATUS AND VACUUM CLEANER HAVING THE SAME

CROSS-REFERENCE TO RELATED APPLICATIONS

This application claims the benefit of U.S. provisional application No. 60/665,942, filed Mar. 29, 2005, in the United States Patent & Trademark Office, and claims the benefit of Korean Patent Application No. 2005-39125, filed May 11, 2005, in the Korean Intellectual Property Office, the disclosure of both of which are incorporated herein by reference.

BACKGROUND OF THE INVENTION

1. Field of the Invention

The present invention relates to a vacuum cleaner. More particularly, the present invention relates to a multi-cyclone apparatus capable of sequentially separating contaminants from a drawn air by a plurality of stages and a vacuum cleaner having the same.

2. Description of the Related Art

A conventional cyclone apparatus is constructed such that, as a vacuum cleaner draws in contaminant-entrained air from a surface being cleaned with a suction force generated from a motor assembly, the cyclone apparatus separates contaminants from the drawn air by a centrifugal force. The cyclone apparatus mainly includes a cyclone that spins the drawn air to separate contaminants, an air inlet through which the air flows in a tangential direction, and a contaminant receptacle which collects contaminants separated from the cyclone. The cyclone apparatus usually has a single cyclone.

As such a conventional cyclone apparatus with a single cyclone separates contaminants regardless of sizes of the contaminants, there was a problem that small-sized contaminants such as dust frequently float in the air and discharged through a discharge port, although relatively large-sized contaminants can be effectively collected. Accordingly, contaminant collecting efficiency deteriorates.

In order to overcome such problems occurring in the art, the same applicant has invented and disclosed a multi-cyclone apparatus which separates contaminants in two stages, in Korean Patent Application No. 10-2004-0009092 (filed Feb. 11, 2004). The multi-cyclone apparatus of KR10-2004-0009092 can provide higher collecting efficiency because it has a single first cyclone and a plurality of second cyclones, which can separate and collect contaminants in two stages.

However, the applicant has now noted a need for still higher contaminant collecting efficiency, and thus provides the present invention to meet such a need.

SUMMARY OF THE INVENTION

The present invention has been made to overcome the above-mentioned problems of the art, and therefore, it is an object of the present invention to provide a multi-cyclone apparatus with high contaminant collecting efficiency, which is capable of sequentially separating and collecting contaminants from a drawn air in the order of contaminant particle sizes, and a vacuum cleaner having the same.

The above aspects and/or other features of the present invention can substantially be achieved by providing a multi-cyclone apparatus, which includes a first collecting unit which separates large-sized contaminants from an air which is drawn through an air suction port, a cyclone body comprising a second cyclone which is communicated with the first collecting unit and separates middle-sized contaminants from the drawn air, and a plurality of third cyclones arranged around the second cyclone and separate small-sized contaminants from the drawn air, an air discharge port communicated with the cyclone body, through which the air is discharged after passing through the third cyclones, and a contaminant receptacle provided to a lower end of the cyclone body, and collects contaminants separated from the second and the third cyclones.

The first collecting unit may include a housing having the air suction port at a lower part, a first discharge port at a predetermined distance away upward from the air suction port, and provided to an inner wall of the housing facing the air suction port, and a guide provided to an inner side of the housing, and guides the drawn air from the air suction port to discharge through the first discharge port after the drawn air collides against the inner wall of the housing.

The first collecting unit may further include a partition disposed between the inner wall of the housing and the air suction port, at a height lower than the guide.

The guide may be in a substantially arc shape. The leading end of the guide may be formed in a substantially concave shape.

According to one aspect of the present invention, a multi-cyclone apparatus may include a first collecting unit comprising an air suction port formed at a lower part, and a first discharge port provided at a predetermined distance upward from the air suction port and facing the air suction port, the first collecting unit separating large-sized contaminants which are drawn through the air suction port, a cyclone body comprising a second cyclone having a first suction port adjoined with the first discharge port and separating middle-sized contaminants from the drawn air, and a plurality of third cyclones arranged around the second cyclone in fluid communication and separating small-sized contaminants from the drawn air, an air discharge port communicated with the cyclone body and discharging the air which is passed through the third cyclones, and a contaminant receptacle provided to a lower end of the cyclone body, and collecting the contaminants which are separated at the second and the third cyclones.

According to another aspect of the present invention, a vacuum cleaner may include a suction brush, a first collecting unit comprising an air suction port formed at a lower part, and a first discharge port provided at a predetermined distance upward from the air suction port and facing the air suction port, the first collecting unit separating large-sized contaminants which are drawn through the air suction port, a cyclone body comprising a second cyclone having a first suction port adjoined with the first discharge port and separating middle-sized contaminants from the drawn air, and a plurality of third cyclones arranged around the second cyclone in fluid communication and separating small-sized contaminants from the drawn air, a contaminant receptacle provided to a lower end of the cyclone body, and collecting the contaminants which are separated at the second and the third cyclones, and a motor assembly communicated with the cyclone body, and generating a suction force.

The first collecting unit may include a housing connecting the air suction port with the first discharge port, a guide provided to an inner side of the housing, and guiding the air to discharge to the first discharge port after the air drawn from the air suction port collides against the inner wall of the housing; and a partition disposed between the inner wall of the housing and the air suction port, at a height lower than the guide.

With a multi-cyclone apparatus and a vacuum cleaner having the same according to the present invention, contaminant-containing air are filtered by three stages, and therefore, contaminant cleaning efficiency improves. More specifically, contaminants can be more effectively cleaned because the large-sized contaminants are separated in the first stage as the air passes through the first collecting unit, the middle-sized contaminants are separated in the second stage as the air passes through the second cyclone, and small-sized contaminants are separated in the third stage as the air passes through the third cyclones.

BRIEF DESCRIPTION OF THE DRAWINGS

The above aspects and features of the present invention will be more apparent by describing certain embodiments of the present invention with reference to the accompanying drawings, in which.

DETAILED DESCRIPTION OF THE EXEMPLARY EMBODIMENTS

Figure 1:
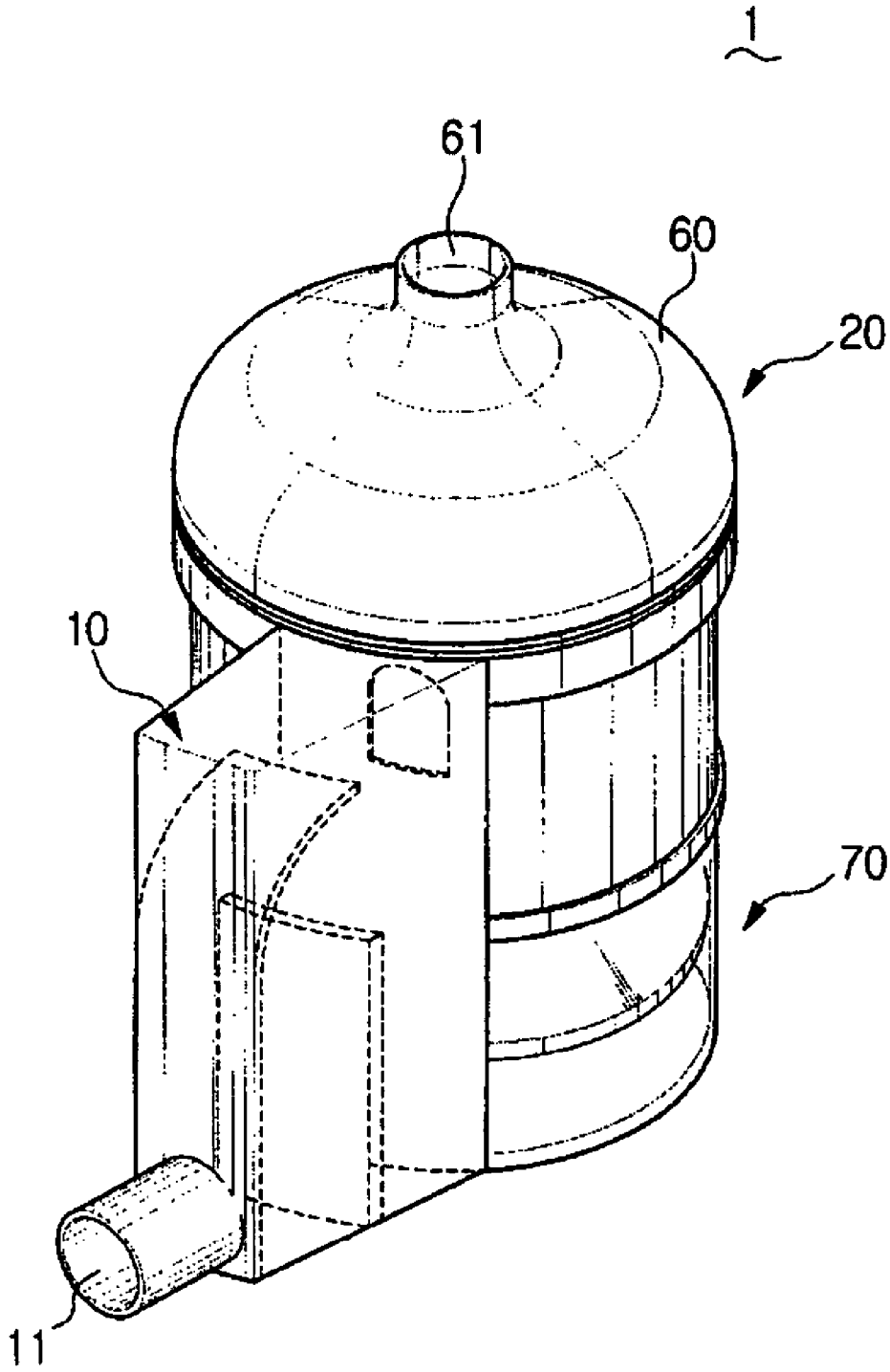
FIG. 1 is a perspective view of a multi-cyclone apparatus according to an embodiment of the present invention.

Certain embodiments of the present invention will be described in greater detail with reference to the accompanying drawings.

In the following description, same drawing reference numerals are used for the same elements even in different drawings. The matters defined in the description such as a detailed construction and elements are nothing but the ones provided to assist in a comprehensive understanding of the invention. Thus, it is apparent that the present invention can be carried out without those defined matters. Also, well-known functions or constructions are not described in detail since they would obscure the invention in unnecessary detail.

Figure 2:
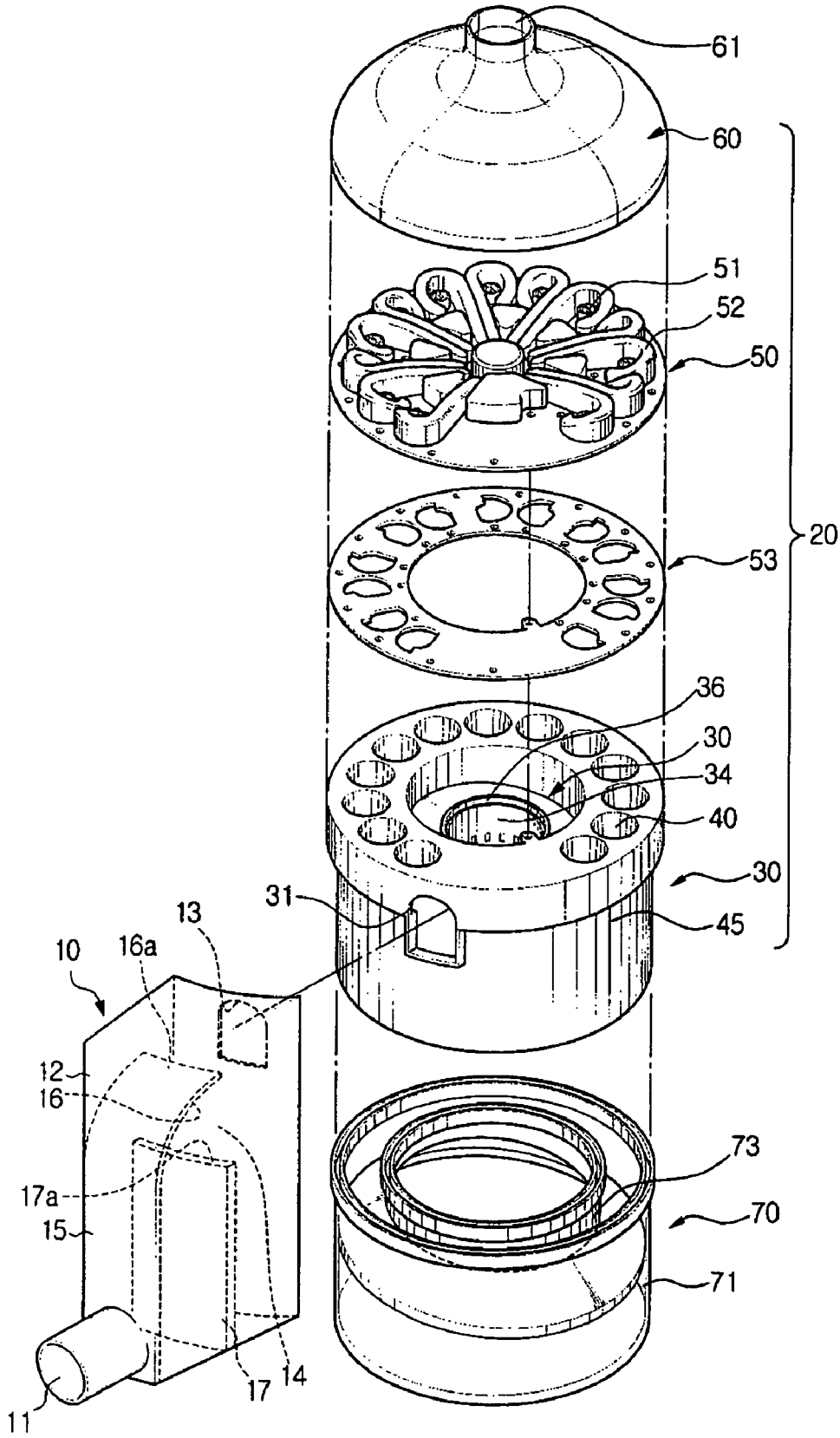
FIG. 2 is an exploded perspective view of the multi-cyclone apparatus of FIG. 1.

Referring to FIGS. 1 and 2, a multi-cyclone apparatus according to an embodiment of the present invention includes a first collecting unit 10, a cyclone body 20 and a contaminant receptacle 70.

The first collecting unit 10 separates relatively large-sized contaminants from an air as entering through an air suction port 11 which is communicated with a suction brush 110 (see FIG. 4), and includes the air suction port 11, a first discharge port 13 and a housing 12.

The housing 12 forms an air passage to connect the air suction port 11 and the first discharge port 13, and takes on the configuration of a substantially rectangular pipe. The air suction port 11 is provided at a lower part of an outer wall 15 of the housing 12. The first discharge port 13 is provided at an upper part of an inner wall 14, which faces the outer wall 15 of the housing 12. The first discharge port 13 is at a predetermined distance upward from the air suction port 11. The first discharge port 13 is connected with a first suction port 31 of the cyclone body 20. In this particular embodiment, the housing 12 is formed in the shape of a rectangular pipe. However, this is only for the exemplary purpose, and therefore, one in the art can appreciate that the housing 12 can be formed in various shapes.

Figure 4:
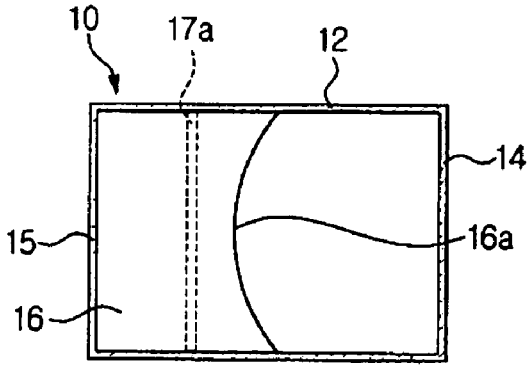
FIG. 4 is a partial sectional view of the first collecting unit of FIG. 3 taken along lines IV-IV.

In order to effectively separate contaminants from the air passing through the first collecting unit 10, there are preferably a guide 16 and a partition 17 provided to the inner side of the housing 12. In this manner, relatively large-sized contaminants are separated from the air incoming through the air suction port 11 and the air with the small-sized contaminants can be discharged through the first discharge port 13. The guide 16 is formed such that the air from the air suction port 11 collides with the inner wall 14 of the housing 12 and then discharges through the first discharge port 13. The guide 16 can be shaped in a variety of manners as long as the incoming air can collide with the inner wall 14 of the housing 12. However, it is preferable that the guide 16 is formed to an arc configuration of a predetermined radius of curvature, with its leading end 16*a* positioned below the first discharge port 13. The leading end 16*a* of the guide 16 is also at a predetermined distance from the inner wall 14 of the housing 12 so that the incoming air can flow through the first discharge port 13. The leading end 16*a* of the guide 16 may take on the linear configuration, while it is more preferable to form the leading end 16*a* to be concave at a predetermined radius of curvature (FIG. 4).

The partition 17 is positioned between the air suction port 11 and the inner wall 14 of the housing 12. The partition 17 has an uppermost end 17*a* at a height lower than leading end 16*a* of the guide 16. The guide 16 extends toward inner wall 14 past partition 17 so that the leading end 16*a* of the guide is closer to the inner wall than uppermost end 17*a* of the partition. Distance between the partition 17 and the guide 16 is determined such that the drawn contaminants can move to the inner wall 14 of the housing 12 without being blocked at the partition 17. The partition 17 prevents contaminants collected between the partition and inner wall 14 from flowing back toward the air suction port 11 while the contaminants collide against the inner wall 14 of the housing 12 and fall. In other words, a space 18 is formed between the partition 17 and the inner wall 14 of the housing 12 to serve as a first contaminant collecting chamber, which collects large-sized contaminants (see FIG. 3).

In the above example, the first collecting unit 10 is exemplified to separate large-sized contaminants using force of gravity and inertia. However, although it is not shown, the large contaminants may also be further separated by using a filter in the first collecting unit 10.

Figure 3:
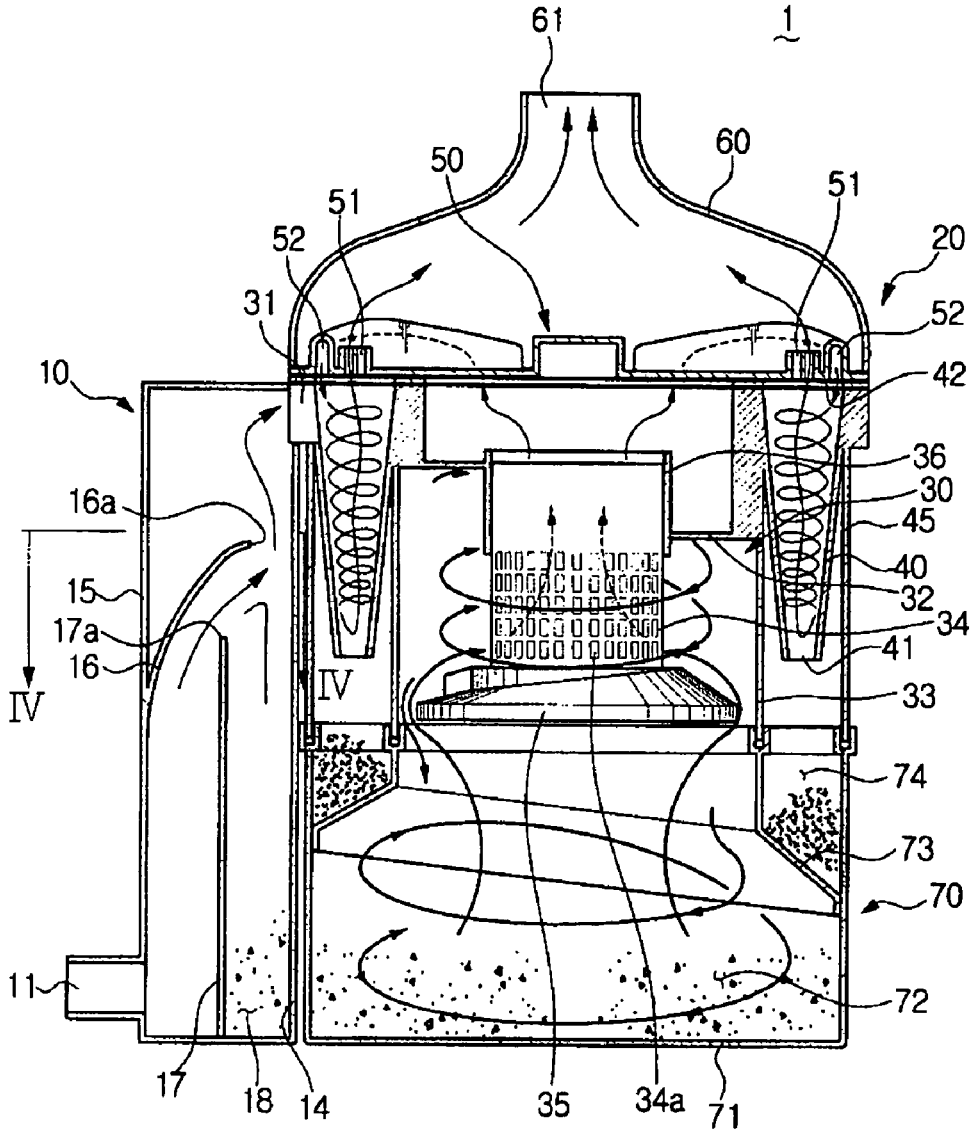
FIG. 3 is a sectional view provided for explaining the operation of the multi-cyclone apparatus separating contaminants from the air according to an embodiment of the present invention.

Referring to FIGS. 2 and 3, the cyclone body 20 includes a second cyclone 30, a third cyclone 40, a first cover 50 and a second cover 60.

The second cyclone 30 is provided to separate middle-sized contaminants from the air, and positioned approximately in the center of the cyclone body 20. The second cyclone 30 includes a first suction port 31, an inner body wall 33, a flow guide member 32 and a grill member 34.

The first suction port 31 is in fluid communication with the first discharge port 13 of the first collecting unit 10, to guide the air discharged through the first discharge port 13 into the second cyclone 30. In this particular embodiment, the first discharge port 13 and the first suction port 31 are adjoined with each other. The inner body wall 33 forms a space where the drawn air spins, and also separates the second cyclone 30 from the third cyclone 40. The flow guide member 32 guides the drawn air from the first suction port 31 to spin, and is provided to the upper part of the second cyclone 30 at the center of the cyclone body 20. A connecting pipe 36 is provided to the center of the flow guide member 32, providing a passage through which the internal air of the second cyclone 30 to flow toward the third cyclone 40. The grill member 34 has a plurality of holes 34*a* in surface thereof, to pass the air with small-sized contaminants toward the third cyclone 40, while blocking the middle-sized contaminants of the second cyclone 30 from passing. Additionally, a skirt 35 is formed at a lower end of the grill member 34 to prevent backflow of the separated contaminants.

The third cyclone 40 is provided to separate small-sized contaminants from the air flowed from the second cyclone 30. More specifically, the third cyclone 40 includes a plurality of third cyclones 40 which are arranged around the second cyclone 30, with each being communicated with the second cyclone 30 through a first cover 50. Each of the third cyclones 40 is formed in a conical configuration that narrows from upper to the lower part. The third cyclones 40 are enclosed by an outer body wall 45. Each of the third cyclones 40 has a contaminant hole 41 at a lower end.

The first cover 50 connects the second and the third cyclones 30 and 40. The first cover 50 is formed on top of the second and the third cyclones 30 and 40. The first cover 50 has centrifugal passages 52 and discharge pipes 51 corresponding in number of that of the third cyclones 40. A gasket 53 is disposed between the first cover 50 and the third cyclones 40 to prevent leakage of air. The centrifugal passage 52 causes the discharged air through the connecting pipe 36 of the second cyclone 30 to spin, and guides to upper gates 42 of the third cyclones 40. The discharge pipes 51 provide passages through which contaminants-free air of the third cyclones 40 can be discharged to the outside.

Figure 5:
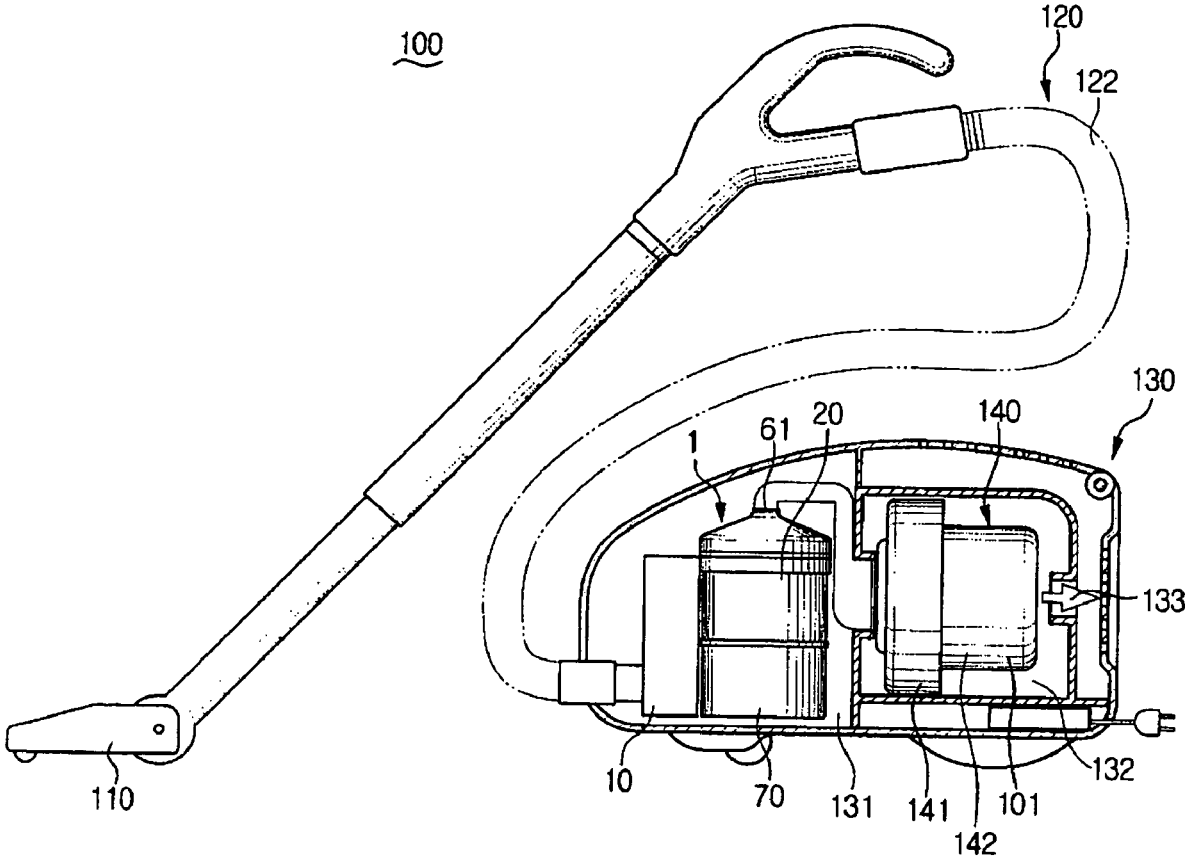
FIG. 5 illustrates an example of a vacuum cleaner employing a multi-cyclone apparatus according to an embodiment of the present invention.

The second cover 60 has an air outlet 61, and is formed to cover the top of the first cover 50. As shown in FIG. 5, the air outlet 61 is communicated with the motor assembly 140 of the vacuum cleaner 100 when the multi-cyclone apparatus 1 is mounted in the vacuum cleaner 100.

The contaminant receptacle 70 is provided to the lower end of the cyclone body 20 to collect contaminants separated from the second and the third cyclones 30 and 40. The contaminant receptacle 70 includes a receptacle body 71 and a partitioning member 73. The partitioning member 73 is formed at an inclined angle with respect to the inner circumference of the receptacle body 71, to separate the interior space of the receptacle body 71 into second and third collecting chambers 72 and 74. The second collecting chamber 72 receives middle-sized contaminants from the second cyclone 30, while the third collecting chamber 74 receives small-sized contaminants from the third cyclones 40. Because there is generally a greater amount of middle-sized contaminants than the small-sized contaminants, it is preferable that the second collecting chamber 72 is sized larger than the third collecting chamber 74. Additionally, as shown in FIG. 2, the partitioning member 73 takes on the configuration of approximate frustum. The approximate frustum shape of the partitioning member 73 is preferred because it is more effective to size the second collecting chamber 72 larger than the third collecting chamber 74, and empty the contaminant receptacle 70 including the second collecting chamber 72.

Although a multi-cyclone apparatus 1 described above has the cyclone body 20 having a single second cyclone 30 and a plurality of third cyclones 40, it is only for the exemplary purpose, and therefore, the number of the second cyclone 30 may be adequately varied to two, three, or more than three, depending on the shape or size of the vacuum cleaner 100.

The operation of the multi-cyclone apparatus 1 having the above constructions will now be described with reference to FIGS. 1 to 3.

As the motor assembly 140 (FIG. 5) generates a suction force, contaminant-laden air is drawn into the first collecting unit 10 through the air suction port 11. The drawn air contains contaminants of varying sizes. The air, which is drawn into the housing 12 of the first collecting unit 10 through the air suction port 11, is moved along the guide 16 toward the inner wall 14. While moving, the air collides against the inner wall 14 of the housing 12 as the passage suddenly changes. Due to the collision, relatively large-sized contaminants drop into space 18, while middle-sized and/or small-sized contaminants are discharged to the first discharge port 13 with the discharging air. The dropping contaminants are piled in the first collecting chamber 18 between the partition 17 and the inner wall 14 of the housing 12. The partition 17 prevents contaminants collected in first collecting chamber 18 from flowing back toward the air suction port 11.

The air from the first discharge port 13 flows into the cyclone body 20 through the first suction port 31, and it still contains, mostly, middle-sized and/or small-sized contaminants. The air flows through the first suction port 31 and then moved to the second cyclone 30 along the flow guide member 32. Due to the spiral pattern (not shown) of the flow guide member 32, the air starts to spin as it enters into the second cyclone 30. As a result, middle-sized contaminants are separated from the air by the centrifugal force and drop. The separated contaminants are piled in the second collecting chamber 72 of the contaminant receptacle 70. However, small-sized contaminants are still entrained in the air and discharged through the grill member 34 together with the air. At this time, backflow of middle-sized contaminants are blocked by the skirt 35.

As the air is passed through the holes 34*a* of the grill member 34, the air flows via the connecting pipe 36 and collides against the first cover 50. After the collision against the first cover 50, the air flows into the third cyclone 40 along the radially-arranged centrifugal passages 52. When the air enters into the third cyclones 40, the air spins, thus shedding the small-sized contaminants by centrifugal force. As a result, contaminant-free air is discharged through the discharge pipe 51 to the upper side of the first cover 50. The small-sized contaminants are piled in the third collecting chamber 74 of the contaminant receptacle 70 through the contaminant hole 41 at the lower end of the third cyclone 40.

The contaminant-free air is discharged from the third cyclones 40 through a plurality of discharge pipes 51 of the first cover 50 to the upper side of the first cover 50, moved along the second cover 60 and discharged through the air outlet 61. The discharge air from the air outlet 61 is drawn into the motor assembly 140 (FIG. 5) and discharged to the outside of the vacuum cleaner 100 (FIG. 5).

With the multi-cyclone apparatus 1 according to the above-described embodiment of the present invention, large-sized contaminant are separated in the first stage as the air passes through the first collecting unit 10, middle-sized contaminants are separated in the second stage as the air passes through the second cyclone 30, and small-sized contaminants are separated in the third stage as the air passes through the third cyclones 40. As a result, contaminant cleaning process can be efficiently preformed. In other words, the multi-cyclone apparatus 1 according to the embodiment of the present invention can clean the contaminants by the three stages, and therefore provides high contaminant collecting efficiency. In the above description, the terms "large-sized", "middle-sized" and "small-sized" were used to define the contaminants entering the multi-cyclone apparatus 1 according to relative size and weight.

Hereinbelow, an example of a vacuum cleaner 100 having the above multi-cyclone apparatus 1 will be described with reference to FIG. 5.

Referring to FIG. 5, the vacuum cleaner 100 includes a suction brush 110 which draws in contaminants, an extension pipe assembly 120 which connects the suction brush 110 with a cleaner body 130, and the cleaner body 130 partitioned into a contaminant chamber 131 and a motor chamber 132.

The suction brush 110 includes a contaminant suction port (not shown) for drawing in contaminants of various sizes from a surface being cleaned.

The extension pipe assembly 120 includes an extension pipe 121 which is connected with the suction brush 110, and a flexible hose 122 which is connected with one end to the extension pipe 121 and connected with the other end to the multi-cyclone apparatus 1 of the cleaner body 130.

More specifically, the multi-cyclone apparatus 1 is installed in the contaminant chamber 131 of the cleaner body 130 to separate and collect contaminants from the incoming air. The multi-cyclone apparatus 1 includes a first collecting unit 10, a cyclone body 20 and a contaminant receptacle 70. An air suction port 11 of the first collecting unit 10 is communicated with the flexible hose 122 of the extension pipe assembly 120. Accordingly, when the air is drawn in through the suction brush 110, the air flows into the first collecting unit 10 via the extension pipe assembly 120. The first collecting unit 10 separates and collects the large-sized contaminants from the air. The cyclone body 20 includes a second cyclone 30 and a third cyclone 40, to sequentially remove middle-sized contaminants and small-sized contaminants from the air which is coming from the first collecting unit 10. The contaminant receptacle 70 includes a second collecting chamber 72 and a third collecting chamber 74 (FIG. 3) to separate and collect middle-sized contaminants and small-sized contaminants, which are separated at the second and the third cyclones 30 and 40. The detailed structure of the multi-cyclone apparatus 1 has already been introduced in the above, and therefore will be omitted in the following for the sake of brevity.

A motor assembly 140 is housed in the motor chamber 132 of the cleaner body 130, to generate a suction force to draw in contaminant-entrained air from the suction brush 110. The motor assembly 140 includes a motor 142, an impeller (not shown) rotated by the motor 142, and a diffuser 141 which induces the air drawn by the impeller toward the motor 142.

Accordingly, when the motor 142 of the vacuum cleaner 100 constructed as above rotates, the impeller rotates and therefore, suction force is generated. By the suction force as generated, air containing various sizes of contaminants are drawn in through the contaminant suction port of the suction brush 110. The drawn air and the contaminants are flowed into the air suction port 11 of the multi-cyclone apparatus 1 through the extension pipe 121 and the flexible hose 122 of the extension pipe assembly 120. As the air enters into the air suction port 11, the air passes through the first collecting unit 10, the second cyclone 30 and the third cyclone 40, in each stage shedding large-sized, middle-sized and small-sized contaminants. Therefore, the contaminant-free air is discharged to the motor assembly 140 through the air outlet 61. The large-sized, middle-sized and small-sized contaminants, being sequentially removed by the first collecting unit 10, the second cyclone 30 and the third cyclone 40, are collected in the first, the second and the third collecting chambers 18, 72, 74, respectively (FIG. 3). The sequentially separation and collection of the contaminants according to their sizes have already been explained above, and therefore, will be omitted in the following for the sake of brevity.

The clean air, which is removed of contaminants as it passes through the multi-cyclone apparatus 1, passes the impeller and the diffuser 141 of the motor assembly 140 and discharged to the outside of the cleaner body 130.

The foregoing embodiments and advantages are merely exemplary and are not to be construed as limiting the present invention. The present teaching can be readily applied to other types of apparatuses. Also, the description of the embodiments of the present invention is intended to be illustrative, and not to limit the scope of the claims, and many alternatives, modifications, and variations will be apparent to those skilled in the art.

What is claimed is:

1. A multi-cyclone apparatus, comprising:

a first collecting unit having an air suction port, the first collecting unit separating large-sized contaminants from an air that is drawn through the air suction port;

a cyclone body comprising a second cyclone in fluid communication with the first collecting unit and a plurality of third cyclones arranged around and in fluid communication with the second cyclone, the second cyclone separating middle-sized contaminants from the drawn air and the plurality of third cyclones separating small-sized contaminants from the drawn air;

an air discharge port in fluid communication with the cyclone body, through which the air is discharged after passing through the plurality of third cyclones; and a contaminant receptacle provided at a lower end of the cyclone body, the contaminant receptacle collecting the middle-sized and small-sized contaminants, wherein the first collecting unit comprises:

a housing having the air suction port at a lower part;

a first discharge port spaced a predetermined distance upward from the air suction port, the first discharge port being provided in an inner wall of the housing facing the air suction port; and a guide provided to an inner side of the housing, and guides the drawn air from the air suction port to discharge through the first discharge port after the drawn air collides against the inner wall of the housing.

2. The multi-cyclone apparatus of claim 1, wherein the first collecting unit further comprises a partition disposed between the inner wall of the housing and the air suction port, the partition having an uppermost end having a height lower than a leading end of the guide.

3. The multi-cyclone apparatus of claim 1, wherein the guide is in a substantially arc shape.

4. The multi-cyclone apparatus of claim 1, wherein the guide has a leading end having a substantially concave shape.

5. A multi-cyclone apparatus, comprising:

a first collecting unit comprising an air suction port formed at a lower part, and a first discharge port provided at a predetermined distance upward from the air suction port and facing the air suction port, the first collecting unit separating large-sized contaminants which are drawn through the air suction port;

a cyclone body comprising a second cyclone and a plurality of third cyclones, the second cyclone having a first suction port in fluid communication with the first discharge port and separating middle-sized contaminants from the drawn air, and the plurality of third cyclones arranged around and in fluid communication with the second cyclone and separating small-sized contaminants from the drawn air;

an air discharge port in fluid communication with the cyclone body and discharging the air which is passed through the plurality of third cyclones; and a contaminant receptacle provided to a lower end of the cyclone body, and collecting the middle-sized and small-sized contaminants.

6. The multi-cyclone apparatus of claim 5, wherein the first collecting unit comprises:

a housing connecting the air suction port with the first discharge port; and a guide provided to an inner side of the housing, and guiding the air to discharge to the first discharge port after the air drawn from the air suction port collides against an inner wall of the housing.

7. The multi-cyclone apparatus of claim 6, wherein the first collecting unit further comprises a partition disposed between the inner wall of the housing and the air suction port, the partition having an uppermost end having a height lower than a leading end of the guide.

8. The multi-cyclone apparatus of claim 6, wherein the guide comprises a leading end that is concave.

9. A vacuum cleaner comprising:

a suction brush;

a first collecting unit comprising an air suction port in fluid communication with the suction brush and a first discharge port, the air suction port being formed at a lower part and the first discharge port being provided at a predetermined distance upward from the air suction port and facing the air suction port, the first collecting unit separating large-sized contaminants which are drawn through the air suction port;

a cyclone body comprising a second cyclone and a plurality of third cyclones, the second cyclone having a first suction port in fluid communication with the first discharge port and separating middle-sized contaminants from the drawn air, and the plurality of third cyclones arranged around and in fluid communication with the second cyclone and separating small-sized contaminants from the drawn air;

a contaminant receptacle provided to a lower end of the cyclone body, and collecting the middle-sized and small-sized contaminants; and a motor assembly in fluid communication with the suction brush through the cyclone body and the first collecting unit, and generating a suction force.

10. The vacuum cleaner of claim 9, wherein the first collecting unit comprises:

a housing connecting the air suction port with the first discharge port;

a guide provided to an inner side of the housing, and guiding the air to discharge to the first discharge port after the air drawn from the air suction port collides against an inner wall of the housing; and a partition disposed between the inner wall of the housing and the air suction port, the partition having an uppermost end having a height lower than a leading end of the guide.

* * * * *